US008897659B2

(12) United States Patent
Kim et al.

(10) Patent No.: US 8,897,659 B2
(45) Date of Patent: Nov. 25, 2014

(54) APPARATUS AND METHOD TO CONTROL TEMPERATURE OF HEATING ROLLER USED IN FUSING DEVICE OF IMAGE FORMING APPARATUS

(75) Inventors: Dae-hwan Kim, Seoul (KR); Keon Kuk, Yongin-si (KR); Jin-han Kim, Suwon-si (KR); Jun-o Kim, Yongin-si (KR); Tatsuhiro Otsuka, Suwon-si (KR); Young-dae Ko, Sunwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 230 days.

(21) Appl. No.: 13/064,634

(22) Filed: Apr. 5, 2011

(65) Prior Publication Data

US 2011/0280601 A1 Nov. 17, 2011

(30) Foreign Application Priority Data

May 17, 2010 (KR) ..... 10-2010-0046022

(51) Int. Cl.
*G03G 15/20* (2006.01)

(52) U.S. Cl.
CPC ..... *G03G 15/2039* (2013.01); *G03G 15/2042* (2013.01); *G03G 15/2082* (2013.01)
USPC ..... 399/45

(58) Field of Classification Search
USPC ..... 399/328, 329
See application file for complete search history.

(56) References Cited

U.S. PATENT DOCUMENTS 6,292,647 B1 * 9/2001 Ishida ..... 399/330
6,320,168 B1 * 11/2001 Kimata et al. ..... 219/619
6,724,999 B2 4/2004 Kikuchi et al.
7,215,919 B2 5/2007 Kinouchi et al.
7,268,327 B2 9/2007 Yamamoto et al.
7,319,840 B2 1/2008 Matsumoto
7,450,872 B2 11/2008 Ueno et al.
7,835,681 B2 * 11/2010 Takagi et al. ..... 399/334
7,949,290 B2 5/2011 Yoshikawa
2009/0175664 A1 7/2009 Nanjo et al.

FOREIGN PATENT DOCUMENTS

EP 2136267 A1 12/2009
JP 2000-215976 8/2000
JP 2001-034097 2/2001

OTHER PUBLICATIONS

European Search Report dated Sep. 5, 2011 issued in correspondence with European Patent Application No. 11165569.2.
14/073,329, filed Nov. 6, 2013, Dae-hwan Kim, Samsung Electronics Co., Ltd.

(Continued)

*Primary Examiner* — Quana M Grainger
(74) *Attorney, Agent, or Firm* — Staas & Halsey LLP

(57) ABSTRACT

The apparatus includes a heating roller that generates heat for melting toner attached to a printing medium; a first induction coil that is disposed outside the heating roller and heats the heating roller by using induced current generated according to current flowing through the first induction coil; two second induction coils that are disposed at upper portions of both ends of the first induction coil and heat the heating roller by using induced current generated according to current flowing through the two second induction coils; a power supply unit that supplies current to the first induction coil and the two second induction coils; and a control unit that controls the power supply unit to supply current flowing in the same direction or different directions to the first induction coil and the second induction coils according to the size of paper fed into the heating roller.

10 Claims, 5 Drawing Sheets

(56) References Cited

OTHER PUBLICATIONS

U.S. Notice of Allowance issued Jul. 2, 2014 in copending U.S. Appl. No. 14/073,329.

U.S. Office Action issued Mar. 13, 2014 in copending U.S. Appl. No. 14/073,329.

* cited by examiner

APPARATUS AND METHOD TO CONTROL TEMPERATURE OF HEATING ROLLER USED IN FUSING DEVICE OF IMAGE FORMING APPARATUS

CROSS-REFERENCE TO RELATED APPLICATIONS

This application claims the benefit of Korean Patent Application No. 10-2010-0046022, filed on May 17, 2010, in the Korean Intellectual Property Office, the disclosure of which is incorporated herein in its entirety by reference.

BACKGROUND

1. Field

Aspects relate to an apparatus and method to control the temperature of a heating roller used in a fusing device of an image forming apparatus.

2. Description of the Related Art

In order to perform printing at high speed, an induction heating fusing device that heats a surface of a heating roller at high speed is often used in an image forming apparatus. The induction heating fusing device is categorized as an internal coil type fusing device in which a ferrite core and an induction coil for heating the heating roller are located inside the heating roller or as an external coil type fusing device in which an inductor composed of an induction coil and a ferrite core is located outside the heating roller. The internal coil type fusing device has problems in that it takes lots of time for heat output from a heating element inside the heating roller to reach the surface of the heating roller and when the heating roller needs to be replaced, both the ferrite core and the induction coil, which are generally expensive, should be replaced. Accordingly, in order to solve the problems mentioned above, the external coil type fusing device is used. The external coil type fusing device is configured in such a way that the induction coil is wound in a horseshoe-like shape at both ends of the heating roller. In this configuration, however, the heating performance at both ends of the heating roller is drastically reduced due to a change in an electromagnetic field in both ends of the heating roller. Accordingly, the external coil type fusing device has problems in that, in order to increase the heating performance, the heating roller should be lengthened, thereby increasing the size of the image forming apparatus, and when sheets of paper having a size that is less than the size of the heating roller, such as B5 size paper, are continuously printed, the temperature of an unused area of the heating roller on which paper is not passed is increased. Accordingly, there is a demand for a method of preventing the temperature of an unused area of a heating roller from increasing even when paper having a small size is printed, without increasing the size of the heating roller.

SUMMARY

The present invention provides an apparatus for controlling the temperature of a heating roller used in a fusing device of an image forming apparatus, wherein use thereof may allow printing to be performed with high efficiency without increasing the size of the heating roller and may prevent the temperature of an unused area of the heating roller from increasing when paper having a small size is printed.

According to an aspect, there is provided an apparatus for controlling the temperature of a heating roller used in a fusing device of an image forming apparatus, the apparatus including: the heating roller that generates heat for melting toner attached to a printing medium; a first induction coil that is disposed outside the heating roller and heats the heating roller by using induced current generated according to current flowing through the first induction coil; two second induction coils that are disposed at upper portions of both ends of the first induction coil and heat the heating roller by using induced current generated according to current flowing through the two second induction coils; a power supply unit that supplies current to the first induction coil and the two second induction coils; and a control unit that controls the power supply unit to supply current flowing in the same direction or different directions to the first induction coil and the second induction coils according to the size of paper fed into the heating roller.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

The embodiments will now be described more fully with reference to the accompanying drawings, in which exemplary embodiments of the invention are shown.

Figure 1:
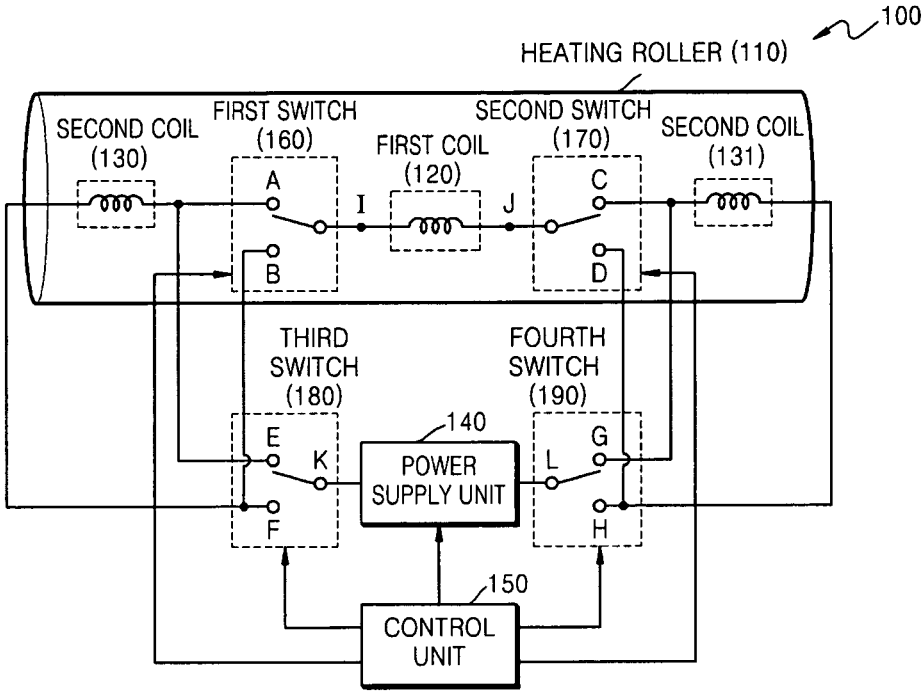
FIG. 1 is a diagram illustrating an apparatus for controlling the temperature of a heating roller used in a fusing device of an image forming apparatus, according to an embodiment.

FIG. 1 is a diagram illustrating an apparatus 100 for controlling the temperature of a heating roller 110 used in a fusing device of an image forming apparatus, according to an embodiment.

Referring to FIG. 1, the apparatus 100 includes the heating roller 110, a first induction coil 120, second induction coils 130 and 131, a power supply unit 140, a first switch 160, a second switch 170, a third switch 180, and a fourth switch 190.

The heating roller 110 is a heating member including a magnetic body, and emits heat due to induced currents generated by the first induction coil 120 and the second induction coils 130 and 131.

The first induction coil 120 is disposed outside the heating roller 110, and heats the heating roller 110 by using induced current generated according to current flowing through the first induction coil 120.

The second induction coils 130 and 131 are disposed on upper portions of both ends of the first induction coil 120, and heat the heating roller 110 by using induced current generated according to current flowing through the second induction coils 130 and 131.

Figure 2:
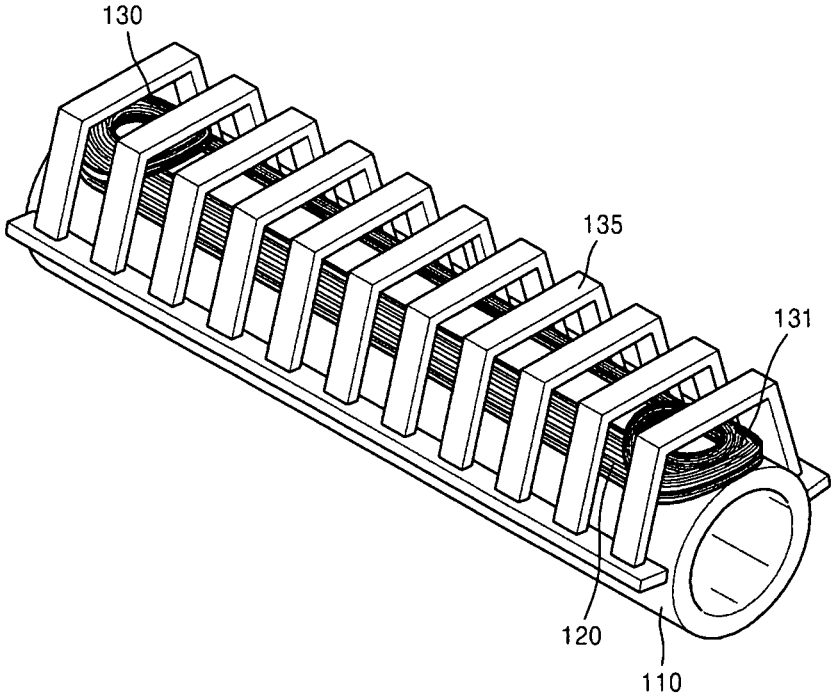
FIG. 2 is a perspective view illustrating an arrangement of the heating roller, a first induction coil, and second induction coils in the apparatus of FIG. 1, according to an embodiment.

FIG. 2 is a perspective view illustrating an arrangement of the heating roller 110, the first induction coil 120, and the second induction coils 130 and 131 in the apparatus 100 of FIG. 1, according to an embodiment.

Referring to FIG. 2, the heating roller 110 has a cylindrical shape, and the first induction coil 120 formed of a plurality of conductive wires that are wound longitudinally around a central axis of the heating roller is disposed outside the heating roller 110. Meanwhile, the second induction coils 130 and 131 formed of pluralities of conductive wires that are wound circularly are disposed on the upper portions of both ends of the first induction coil 120. A U-shaped core 135 is disposed outside the first induction coil 120 and the second induction coils 130 and 131. Here, the U-shaped core 135 is generally formed of a metal, such as ferrite, and is formed by disposing a plurality of U-shaped metal parts perpendicularly to the central axis of the heating roller 110 and at regular intervals along a line parallel to the central axis of the heating roller 110. The U-shaped core 135 prevents induced currents generated by the first induction coil 120 and the second induction coils 130 and 131 from leaking out of the heating roller 110.

Figure 3:
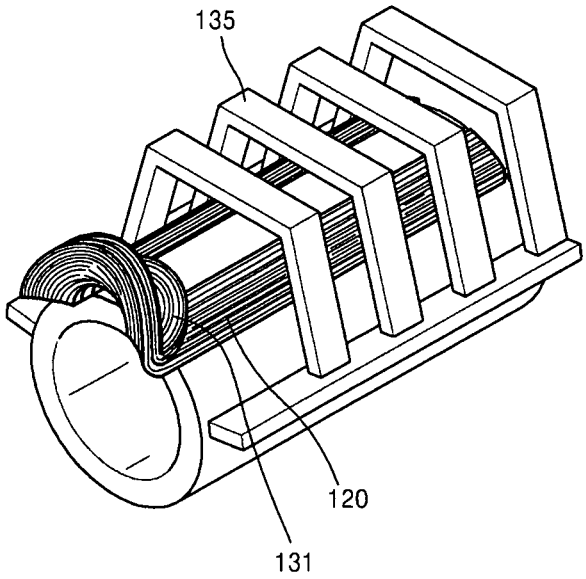
FIG. 3 is a perspective view illustrating an arrangement of the heating roller, the first induction coil, and the second induction coils in the apparatus of FIG. 1, according to another embodiment.

FIG. 3 is a perspective view illustrating an arrangement of the heating roller 110, the first induction coil 120, and the second induction coils 130 and 131 in the apparatus 100 of FIG. 1, according to another embodiment.

In comparison with the arrangement in FIG. 2, referring to FIG. 3, overlapping portions between the first induction coil 120 and the second induction coils 130 and 131 are disposed outside both ends of the heating roller 110 and are bent perpendicularly away from the heating roller 110. Accordingly, since the first induction coil 120 and the second induction coils 130 and 131 are lengthened, the heating roller 120 may not have to be lengthened.

Referring back to FIG. 1, the power supply unit 140 supplies high voltage alternating current (AC) to the first induction coil 120 and the second induction coils 130 and 131. Each of the first induction coil 120 and the second induction coils 130 and 131 generates induced current according to the AC supplied by the power supply unit 140, the generated induced current flows through the heating roller 110, and thus the heating roller 110 emits heat.

The control unit 150 controls the power supply unit 140 to supply current flowing in the same direction or different directions to the first induction coil 120 and the second induction coils 130 and 131 according to the size of paper fed into the heating roller 110. In detail, the control unit 150 controls the direction of current supplied from the power supply unit 140 to the first induction coil 120 and the second induction coils 130 and 131 by operating the first switch 160, the second switch 170, the third switch 180, and the fourth switch 190 according to the size of paper fed into the heating roller 110. The first switch 160 connects one end of the first induction coil 120 to one end or the other end of the second induction coil 130, the second switch 170 connects the other end of the first induction coil 120 and one end or the other end of the second induction coil 131, the third switch 180 connects one end of the power supply unit 140 to the one end or the other end of the second induction coil 130, and the fourth switch 190 connects the other end of the power supply unit 140 to the one end or the other end of the second induction coil 131.

Figure 4:
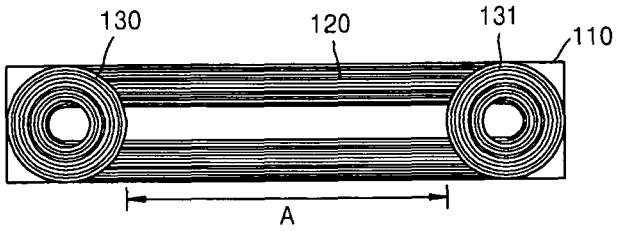
FIG. 4 is a cross-sectional view for explaining a method of determining a direction in which current flows through the first induction coil and the second induction coils in a control unit of the apparatus of FIG. 1, according to an embodiment.

FIG. 4 is a cross-sectional view for explaining a method of determining a direction in which current flows through the first induction coil 120 and the second induction coils 130 and 131 in the control unit 150 of the apparatus 100 of FIG. 1, according to an embodiment.

Referring to FIG. 4, the first induction coil 120 and the second induction coils 130 and 131 are disposed outside the heating roller 110. If the width of paper fed into the heating roller 110 is less than an interval A between the second induction coils 130 and 131, the control unit 150 controls the power supply unit 140 to supply current flowing in different directions to the first induction coil 120 and the second induction coils 130 and 131. If the width of paper fed into the heating roller 110 is greater than the interval A between the second induction coils 130 and 131, the control unit 150 controls the power supply unit 140 to supply current flowing in the same direction to the first induction coil 120 and the second induction coils 130 and 131. Accordingly, if the width of paper fed into the heating roller 110 is less than the interval A, current flowing in different directions is supplied to the first induction coil 120 and the second induction coils 130 and 131, thereby offsetting induced currents of the first induction coil 120 and the second induction coils 130 and 131. Accordingly, unused areas of the heating roller 110 corresponding to the positions of the second induction coils 130 and 131 have weak heat emission, and thus the temperatures of both ends of the heating roller 110 are not increased. Also, if current flowing in the same direction is supplied to the first induction coil 120 and the second induction coils 130 and 131, induced currents of the first induction coil 120 and the second induction coils 130 and 131 overlap at both ends of the heating roller 110. Accordingly, both ends of the heating roller 110 corresponding to the positions of the second induction coils 130 and 131 have strong heat emission. Accordingly, even without increasing the size of the heating roller 110, both ends of the heating roller 110 may offer high heat emission efficiency.

Figure 5:
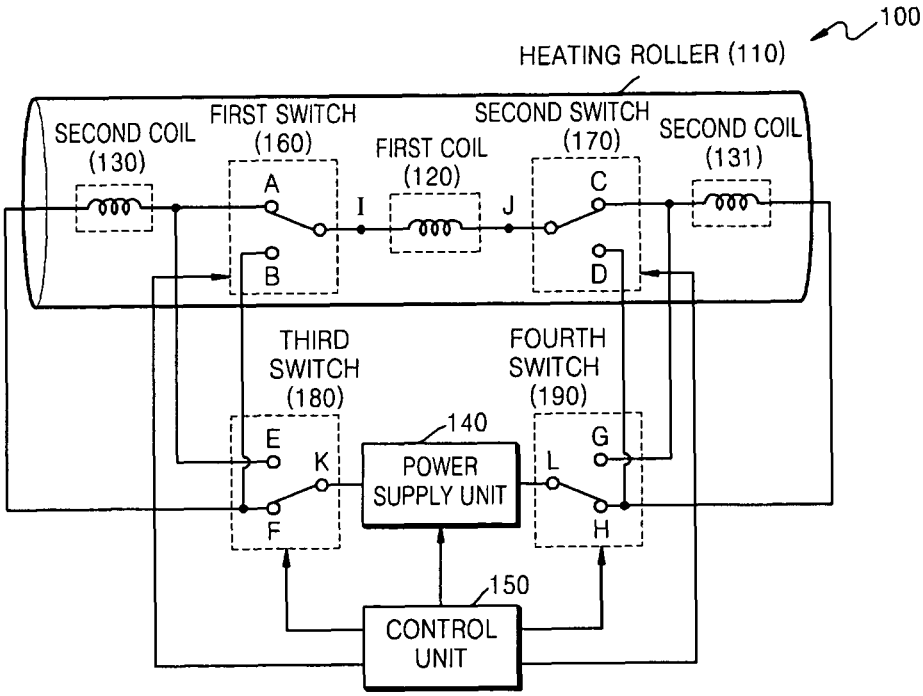
FIG. 5 is a diagram illustrating a case where current flowing in the same direction is supplied to the first induction coil and the second induction coils in the apparatus of FIG. 1, according to an embodiment.

FIG. 5 is a diagram illustrating a case where current flowing in the same direction is supplied to the first induction coil 120 and the second induction coils 130 and 131 in the apparatus 100 of FIG. 1, according to an embodiment.

The control unit 150 outputs a first control signal to the first switch 160 to connect an end I of the first induction coil 120 to an end A of the second induction coil 130, and outputs a second control signal to the second switch 170 to connect an end J of the first induction coil 120 to an end C of the second induction coil 131. Also, the control unit 150 outputs a third control signal to the third switch 180 to connects an end K of the power supply unit 140 to an end F of the second induction coil 130, and outputs a fourth control signal to the fourth switch 190 to connect an end L of the power supply unit 140 to an end H of the second induction coil 131. Once the first, second, third, and fourth switches 160, 170, 180, and 190 are connected as described above, current flows in the same direction through the first induction coil 120 and the second induction coils 130 and 131.

Figure 6:
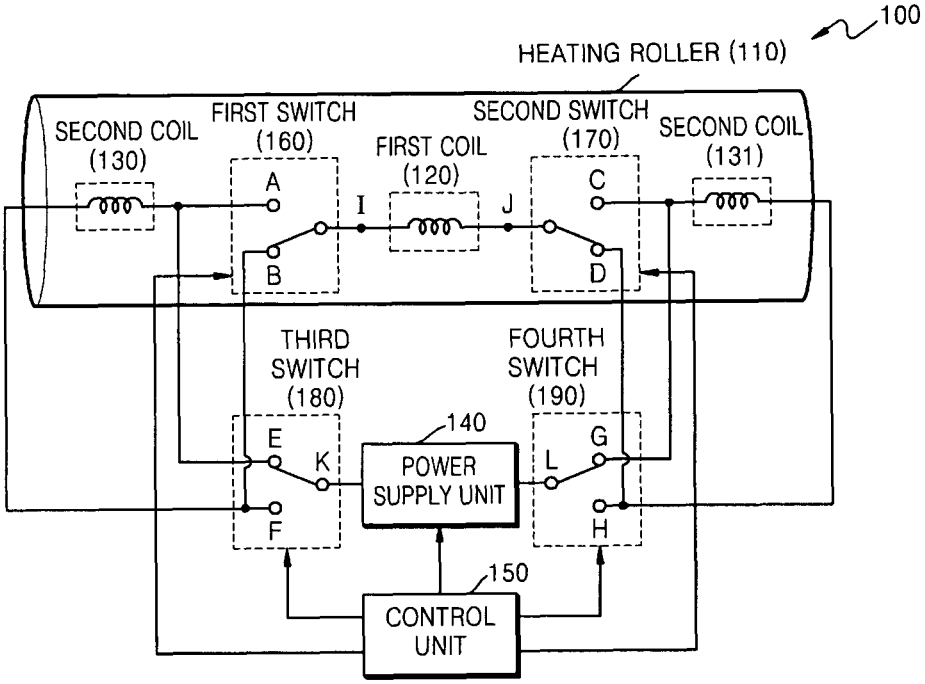
FIG. 6 is a diagram illustrating a case where current flowing in different directions is supplied to the first induction coil and the second induction coils in the apparatus of FIG. 1, according to an embodiment.

FIG. 6 is a diagram illustrating a case where current flowing in different directions is supplied to the first induction coil 120 and the second induction coils 130 and 131 in the apparatus 100 of FIG. 1, according to an embodiment.

The control unit 150 outputs a fifth control signal to the first switch 160 connect the end I of the first induction coil 120 to an end B of the second induction coil 130, and outputs a sixth control signal to the second switch 170 to connect the end J of the first induction coil 120 to an end D of the second induction coil 131. Also, the control unit 150 outputs a seventh control signal to the third switch 180 to connect the end K of the power supply unit 140 to an end E of the second induction coil 130, and outputs an eighth control signal to the fourth switch 190 so to connect the end L of the power supply unit 140 to an end G of the second induction coil 131. Once the first, second, third, and fourth switches 160, 170, 180, and 190 are connected as described above, current flows in different directions through the first induction coil 120 and the second induction coils 130 and 131.

While the present invention has been particularly shown and described with reference to exemplary embodiments thereof using specific terms, the embodiments and terms have been used to explain the present invention and should not be construed as limiting the scope of the present invention defined by the claims. The preferred embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. An apparatus to control the temperature of a heating roller used in a fusing device of an image forming apparatus, the apparatus comprising:

the heating roller that generates heat to melt toner attached to a printing medium;

a first induction coil that is disposed outside the heating roller and heats the heating roller by using induced current generated according to current flowing through the first induction coil;

two second induction coils that are disposed at upper portions of both ends of the first induction coil and heat the heating roller by using induced current generated according to current flowing through the two second induction coils;

a power supply unit that supplies current to the first induction coil and the two second induction coils; and a control unit configured to control the power supply unit to supply current flowing in the same direction to the first induction coil and the second induction coils or in a different direction to the first induction coil with respect to the second induction coils according to the size of paper fed into the heating roller, wherein, if the size of paper fed into the heating roller is less than a preset size, the control unit controls the power supply unit to supply current flowing in different directions to the first induction coil and the second induction coil so that the direction in which the current flows through the first induction coil is opposite to the direction in which the current flows through the second induction coils.

2. The apparatus of claim 1, wherein, if the size of paper fed into the heating roller is greater than a preset size, the control unit controls the power supply unit to supply current flowing in the same direction to the first induction coil and the second induction coils so that the direction in which the current flows through the first induction coil is the same as the direction in which the current flows through the second induction coils.

3. The apparatus of claim 1, wherein overlapping portions between the first induction coil and the second induction coils are disposed at both ends of the heating roller and are bent perpendicularly away from the heating roller.

4. The apparatus of claim 1, wherein the first induction coil is formed of a plurality of conductive wires that are wound longitudinally around a central axis of the heating roller.

5. The apparatus of claim 1, wherein the second induction coils are formed of pluralities of conductive wires that are wound circularly at upper portions of both ends of the first induction coil.

6. The apparatus of claim 1, further comprising:

a first switch that connects a first end of the first induction coil to a first end or a second end of the second induction coil located at an upper portion of a left end of the first induction coil;

a second switch that connects a second end of the first induction coil to a first end or a second end of the second induction coil located at an upper portion of a right end of the first induction coil;

a third switch that connects a first end of the power supply unit to the first end or the second end of the second induction coil located at the upper portion of the left end of the first induction coil; and a fourth switch that connects a second end of the power supply unit to the first end or the second end of the second induction coil located at the upper portion of the right end of the first induction coil.

7. The apparatus of claim 6, wherein the control unit controlling current to flow in the same direction through the first induction coil and the second induction coils comprises:

outputting a first control signal to the first switch to connect the first end of the of the first induction coil to the first end of the second induction coil located at the upper portion of the left end of the first induction coil;

outputting a second control signal to the second switch to connect the second end of the first induction coil to the first end of the second induction coil located at the upper portion of the right end of the first induction coil;

outputting a third control signal to the third switch to connect the first end of the power supply unit to the second end of the second induction coil located at the upper portion of the left end of the first induction coil; and outputting a fourth control signal to the fourth switch to connect the second end of the power supply unit and the second end of the first induction coil to the second end of the second induction coil located at the upper portion of the right end of the first induction coil.

8. The apparatus of claim 6, wherein the control unit controlling current to flow in different directions through the first induction coil and the second induction coils comprises:

outputting a fifth control signal to the first switch to connect the first end of the first induction coil to the second end of the second induction coil located at the upper portion of the left end of the first induction coil;

outputting a sixth control signal to the second switch to connect the second end of the first induction coil to the second end of the second induction coil located at the upper portion of the right end of the first induction coil;

outputting a seventh control signal to the third switch to connect the first end of the power supply unit to the first end of the second induction coil located at the upper portion of the left end of the first induction coil; and outputting an eighth control signal to the fourth switch to connect the second end of the power supply unit and the second end of the first induction coil to the first end of the second induction coil located at the upper portion of the right end of the first induction coil.

9. A method to control the temperature of a heating roller used in a fusing device of an image forming apparatus, comprising:

inducing current through a first induction coil that is disposed outside the heating roller and heating the heating roller by using induced current generated according to current flowing through the first induction coil;

inducing current through two second induction coils that are disposed at upper portions of both ends of the first induction coil and heating the heating roller by using induced current generated according to current flowing through the two second induction coils;

supplying current to the first induction coil and the two second induction coils through a power supply unit that; and controlling the power supply unit to supply current flowing in the same direction to the first induction coil and the second induction coils or in a different direction to the first induction coil with respect to the second induction coils according to the size of paper fed into the heating roller, wherein, if the size of paper fed into the heating roller is less than a preset size, controlling the power supply unit to supply current flowing in different directions to the first induction coil and the second induction coil so that the direction in which the current flows through the first induction coil is opposite to the direction in which the current flows through the second induction coils.

10. The method of claim 9, wherein, if the size of paper fed into the heating roller is greater than a preset size, controlling the power supply unit to supply current flowing in the same direction to the first induction coil and the second induction coils so that the direction in which the current flows through the first induction coil is the same as the direction in which the current flows through the second induction coils.

* * * * *

UNITED STATES PATENT AND TRADEMARK OFFICE

CERTIFICATE OF CORRECTION

PATENT NO. : 8,897,659 B2
APPLICATION NO. : 13/064634
DATED : November 25, 2014
INVENTOR(S) : Dae-hwan Kim et al.

It is certified that error appears in the above-identified patent and that said Letters Patent is hereby corrected as shown below:

In the Claims

Column 6, line 22, in Claim 7, delete "of the of the" and insert -- of the --, therefor.

Signed and Sealed this
Nineteenth Day of May, 2015

Michelle K. Lee

Michelle K. Lee
*Director of the United States Patent and Trademark Office*